United States Patent [19]

Powers

[11] Patent Number: 5,027,842

[45] Date of Patent: Jul. 2, 1991

[54] PROCESS FOR COMMISSIONING PIPELINES

[76] Inventor: Marvin D. Powers, 4400 Memorial Dr., #1206, Houston, Tex. 77007

[21] Appl. No.: 580,776

[22] Filed: Sep. 11, 1990

[51] Int. Cl.[5] ..... 137 1; 137 13; 137 334

[52] U.S. Cl. ..... 137/1; 137/340; F17D/5/00

[58] Field of Search ..... 137/1, 13, 334, 340, 137/341

[56] References Cited

U.S. PATENT DOCUMENTS

| | | | |
|---|---|---|---|
| 3,735,769 | 5/1973 | Miller | 137/340 |
| 3,756,268 | 9/1973 | Lefever | 137/340 |
| 3,864,102 | 2/1975 | Powers | 55/30 |

*Primary Examiner*—Alan Cohan
*Attorney, Agent, or Firm*—Richards, Medlock & Andrews

[57] ABSTRACT

A process for commissioning pipelines is disclosed which more safely, reliably and ecomonically establishes product purity in the line and reduces the possibilities of structural damage to the pipeline. These advantages are achieved through the use of a specially adapted portable heating system. The system is capable of safely heating petrochemical products in a controlled manner and at rates sufficient to provide adequate input flows of commisioning product whose temperature is adjusted to be substantially the same as that of the nitrogen being displaced from the pipeline that is being commissioned.

8 Claims, 1 Drawing Sheet

PROCESS FOR COMMISSIONING PIPELINES

TECHNICAL FIELD OF THE INVENTION

This invention relates to a process for commissioning a pipeline. In another aspect, this invention relates to a system useful for commissioning pipelines at remote field locations. The process and system relate specifically to the special technical, safety and economic problems associated with filling a pipeline with a gaseous or volatile liquid product, primarily a petrochemical product, so that it can be placed in service.

BACKGROUND OF THE INVENTION

Pipelines carrying a variety of gaseous and volatile liquid products are extensively employed in today's industry as a safe and efficient means of transportation. New pipelines must be placed into service initially (i.e., commissioned), and older lines occasionally are taken out of service in order to perform some desired maintenance and are then recommissioned. Among the reasons for taking a pipeline out of service (i.e., decommissioning) are: hydrostatic testing to recertify or upgrade the pipeline's ability to be used at higher operating pressures; performance of construction work on the pipeline; a change in the product transported by the pipeline. Pipelines, or sections thereof, may need to be relocated because of highway work, the necessity to deepen a canal, or because of increases in the population surrounding the pipeline. It may also be necessary to replace valves, fittings or a damaged section of the pipeline or add a new connection to service a customer or supplier.

Typically, decommissioning and recommissioning a petrochemical pipeline will include the steps of decommissioning by removing the product from the pipeline, and flaring any residual product remaining therein. Any necessary construction, upgrading, or cleaning of the pipeline can then be performed. Usually, the pipeline is then filled with water for hydrostatic testing. After pressure testing, the water is removed, the pipeline is cleaned and dried to a specific low dewpoint (to avoid the problems of water contamination of the product) and the pipeline is inerted with nitrogen for recommissioning. U.S. Pat. No. 3,864,102 describes a process and system for drying pipelines to specified dewpoints using dry air.

In order to recommission the pipeline, the nitrogen must be displaced by the desired petrochemical. Before returning to service, product purity must be established and the line safely filled to operating pressure. The terms "commissioning" and "recommissioning" are used interchangeably herein to refer to a process whereby a first inerting gas, normally nitrogen, in a pipeline is replaced with the desired product at the desired purity and pressure.

Safety and economics are two primary concerns for any proposed pipeline operation. Thus, a commissioning process which brings the purity and pressure of potentially explosive products such as ethylene or propylene up to specification quickly, but at the risk of damage to the pipeline or reduced safety to operating personnel, is not acceptable. Similarly, a process which uses large quantities of product to push nitrogen from a line results in wasted product/nitrogen mixtures that must be flared or otherwise disposed of would also be unacceptable. Therefore, the measure of whether a commissioning process actually constitutes a viable improvement over known methods requires consideration of its safety and economic benefits (considering both the cost of wasted product and the cost attributed to the time the line must remain out of service) as well as its ability to bring the line back into service with product at desired pressures and purities.

The main problems posed by recommissioning are (1) the fast and economical purging of nitrogen so as to obtain uncontaminated products in the line, and (2) possible damage to the pipeline due to cold temperatures to which it may be subjected during the process. The latter can be a problem when the pipeline is to be recommissioned with a product at a pressure significantly higher than that of the nitrogen inerted line. The pressure drop of a petrochemical product entering a pipeline can cause rapid drops in temperature and, consequently, potential damage to the carbon steel pipeline.

Due to the demands of the expanding petrochemical industry, and the aging of the present pipeline system, the need for decommissioning, repairing, cleaning, drying and recommissioning pipelines is increasing. Given the value of today's petrochemical products, a recommissioning procedure, which brings the product purity to acceptable levels as quickly as possible, is desirable. Furthermore, processes and equipment which reduce the possibility for damage to the pipeline due to cold temperature conditions which can occur during the recommissioning process are also highly desirable.

SUMMARY OF THE INVENTION

In one aspect, the present invention relates to a process for commissioning a pipeline that has been inerted with nitrogen which includes the step of adding heat to the product which is to be introduced into the pipeline. By controlling pressure drops and the amount of heat added to the product, the temperature of the product, just after delivery into the pipeline, will approximate the temperature of the nitrogen in the pipeline. By effecting this condition (that is, introducing the product into a nitrogen inerted line at approximately the same temperature and pressure as the nitrogen contained therein) an improved commissioning process is achieved because (a) the density of the product and the density of the nitrogen will be more closely matched than in conventional commissioning processes, thereby avoiding extensive product interfaces and the possibility of trapping pockets of less dense nitrogen at high places within the pipeline; and (b) the possible damage (and dangers) of exposing the steel in the pipeline to subdesign temperatures are avoided.

In another aspect, the invention relates to a system for commissioning pipelines which provides for lower amounts of product waste during the commissioning process to achieve reliable levels of product purity while reducing the possibility of pipeline damage due to the stress of subdesign temperatures. In general, the system comprises valving or other means to effect the controlled pressure drop of product withdrawn from the source to be used during the commissioning process; mean for heating the product in a controlled manner to raise its temperature above the temperature of the nitrogen in the inerted line being commissioned; and, a second means for controlling a second pressure drop of the product such that the temperature of the product just after delivery into the line will approximate the temperature of the nitrogen in the pipeline. In a preferred embodiment, the system is portable, that is, operable in remote field locations. The preferred embodiment also includes heating means comprising a tube-shell heat exchanger. Especially preferred is to employ a tube-shell heat exchanger wherein the product is circulated in the tubes and a heat transfer fluid is circulated in the shell. A separate fired heater heats the transfer fluid so that risks of decomposition of products like ethylene to which heat has been added are kept at a minimum. The fired heater and tube-shell heat exchanger, along with appropriate valving for controlling pressure drops, can be trailer mounted and is adapted for use at remote field locations.

BRIEF DESCRIPTION OF THE DRAWINGS

The drawing depicts, schematically, the commissioning system of the invention and the flow of materials which occurs during the process.

DETAILED DESCRIPTION

Figure 1:
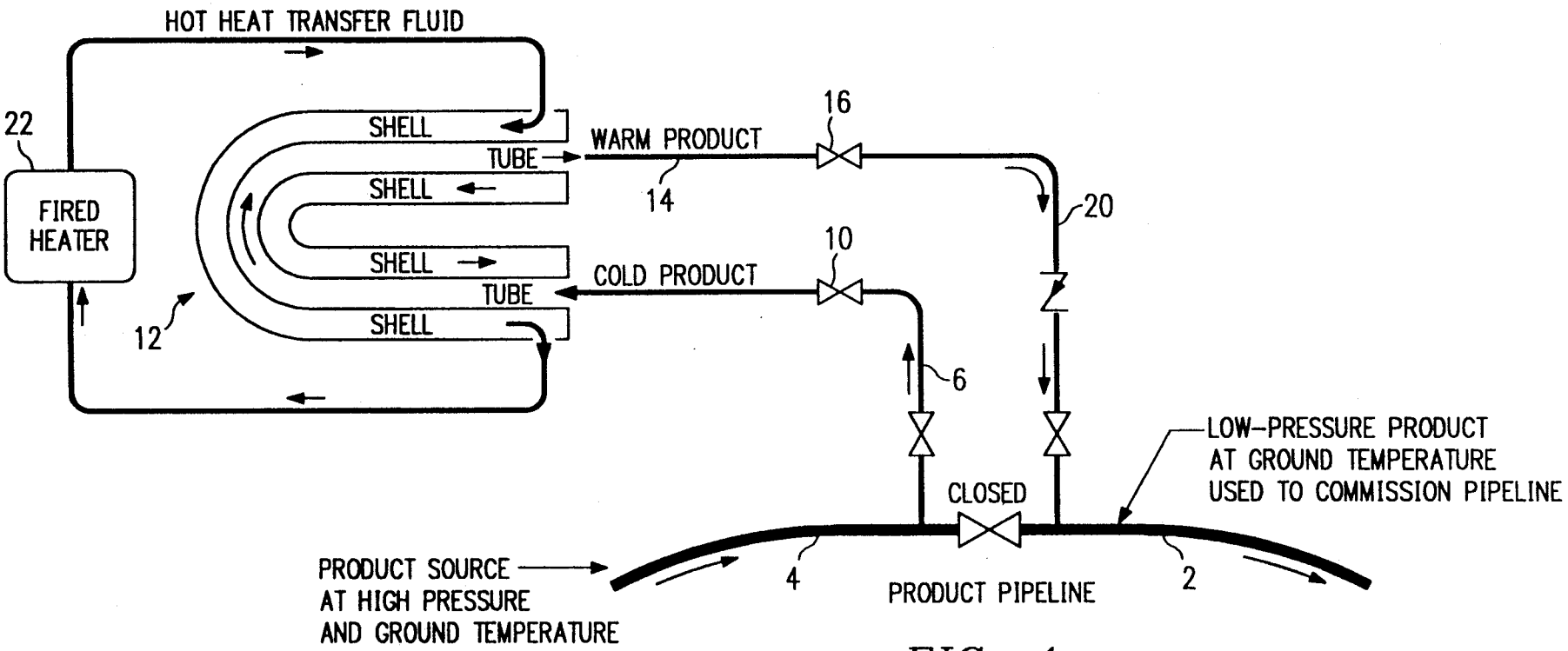

Whenever a pipeline which has been inerted with nitrogen needs to be placed back into service, it is necessary to displace the nitrogen with the product that the pipeline is to transport. Until, and unless, all the nitrogen is removed from the pipeline, the product purity will be unacceptable. Prior to this invention, large amounts of valuable products, such as propylene, ethylene, ethane, propane, and carbon dioxide have been wasted during commissioning and recommissioning procedures. One object of this invention is to reduce the amount of product waste in order to obtain product purity in the pipeline.

One of the problems in purging the pipeline of nitrogen is the fact that the density of nitrogen in the pipeline is often quite different (and normally much lower) than the density of the product being introduced into the pipeline. For example, even though the molecular weight of nitrogen and ethylene are very similar (approximately 28), the density of ethylene at low temperatures or high pressures can be much greater than that of the nitrogen present in the line which is being commissioned. Nitrogen pressure left on the line for commissioning will normally be in the range of from 50 psig to 1,000 psig, depending on the pressure of the product source, the commissioning procedure used, and the pipeline owner's preference. Normally the temperature of the nitrogen will be ground temperature, ranging from about 40° F. to 80° F. or higher. Under these conditions, the density of nitrogen can vary from between 0.07 lbs/cu. ft. up to about 7.4 lbs/cu. ft. at high pressures and relatively low ground temperatures.

Ethylene, as an example of a petrochemical product, has a strikingly different density curve when plotted as a function of temperature and pressure. Typically, ethylene pipelines (the source of product normally used for commissioning) are at pressures over 900 psig and may be up to 2200 psig. At ground temperatures of 40° F. to 70° F., ethylene at these pressures can have densities of well over 20 lbs/cu. ft.

This disparity in densities, if present during the commissioning process, can cause difficulties in attempting to purge the pipeline of nitrogen. The much heavier products will tend to simply flow below the lighter nitrogen and leave the nitrogen trapped in high places in the pipeline system. This can actually cause dangerous conditions wherein false product purities are measured and hidden pockets of nitrogen are not detected until high flow rates in the pipeline are achieved at some later date. Even if the lighter nitrogen does not become trapped at high points, it is thought that its substantially lower density can cause laminar-like flow of the denser product beneath the nitrogen, creating substantial areas of interface between the gases. This condition is the opposite of desired plug-like flow where the leading face of the purging products pushes nitrogen out of the line with minimum mixing of the gases.

Simply reducing the pressure of product as it is introduced into the nitrogen filled line (as is sometimes done in conventional commissioning processes) does not eliminate these problems and may cause another. When products, such as ethylene, are subjected to pressure drops, rapid drops in temperature can occur. The cold product remains relatively dense as it flows into the line and is subject to the undesirable mixing with nitrogen described above. Further, the pressure drop can subject portions of the line to temperatures well below the minimum pipeline design temperature of −20° F. The carbon steel in some pipelines is subject to becoming brittle at such low temperatures and may fail at very low internal pressures. Further, stationary lateral lines connected to the line being commissioned may not be able to move with the cold pipeline as it contracts, thereby causing a pipeline rupture.

If high pressure nitrogen is present and the source of product is also high pressure, cold temperatures can be avoided during commissioning. However, the density of some products, such as petrochemicals, at high pressure and ground temperatures, can still be significantly higher than nitrogen at the same conditions. Therefore, the possibility of trapping pockets of nitrogen remains and the undesirable extensive product interfaces can still exist. In addition, larger volumes of nitrogen must be used and larger amounts of product would be wasted if high pressures are encountered in the commissioning process. Thus, if high pressures are used and a pipeline blow-down is required because of a leak, inadequate purity, or other cause, a major product loss will result.

If relatively warm (i.e., ground temperature) products at relatively low pressures can be made available at remote sites for use during the commissioning process, many of the above problems can be eliminated. Thus, if the product density entering the pipeline is similar to that of the nitrogen contained in the pipeline, the product will more efficiently replace nitrogen throughout the pipeline, faster, and wasting significantly less of the valuable product. As one example, ethylene, at 0 psig, and temperatures in the 70° F. range, has a density of about 0.725 lbs/cu. ft. This closely matches the density of about 0.724 lbs/cu. ft. which the nitrogen to be displaced will have at similar temperatures and pressure.

Thus, the process for commissioning a pipeline which has been inerted with nitrogen which is the subject of this invention, comprises the step of adding heat to the product to be introduced into the pipeline such that the temperature and pressure of the product, just after delivery into the line, will approximate the temperature and pressure of the nitrogen in the pipeline. By delivering product at substantially ground temperature and at relative low pressures in the range of from about 50 to 100 psig, more efficient displacement of nitrogen from the system is facilitated and the pipeline is not subjected to dangerously cold temperatures. Other advantages include the fact that the inerted pipeline can contain relatively low pressure nitrogen, thus saving the cost of having to fill the pipeline with enough nitrogen to obtain relatively high pressures. Further, because relatively low pressure product is introduced into the pipeline, loss of product will be minimal in case a pipeline blow-down is required.

In its preferred embodiments, the process of the present invention includes the steps of adding heat to a source of product by first passing the product through a first pressure drop, then adding heat to the product to raise it above the temperature of the nitrogen in the pipeline, and finally allowing a second drop down to pipeline pressure which brings the temperature of the product down to approximately the temperature of the nitrogen in the pipeline. The two pressure drops can be conveniently undertaken on each side of a tube-shell heat exchanger used as a heat source. A drop in the pressure of the product to approximately 500 psig prior to entering the heat exchanger will normally be sufficient. The approximately 500 psig product will then be warmed by the heat source to approximately 140° F. Next, a second drop in pressure occurs allowing the pressure and temperature of the product to equalize at around ground temperature and pipeline pressures in the aforementioned 20 psig to 100 psig range. When the product being processed is ethylene, it should not be necessary to allow the temperature to drop below 0° F., and the hot will ever be is about 150° F. These are very safe temperature ranges to handle ethylene in carbon steel piping systems.

After filling the pipeline with relatively low pressure product, the system can be checked for leaks and product purity while the pressure is still low and the dollar value of the product in the pipeline is still relatively small. After pressure and purity checks at relatively low pressures have been accomplished, the pressure up phase of the commissioning process can begin. During this pressure up phase it is not necessary to heat the product all the way up to ground temperature, though some heating will be advisable in order to keep the temperature of the product above dangerously cold levels. Because the pressure in the pipeline will be steadily increasing, the amount of heat required per pound of product will steadily decrease.

The above principles for commissioning a pipeline can be used wherever cold temperatures are encountered due to pressure drops. Examples include ethylene, propylene, propane, ethane and carbon dioxide pipeline systems.

Before the above-described process can be carried out safely and economically, a system for quickly, efficiently and safely providing a source of petroleum product at relatively low pressures and ground temperatures must be available. Unless such a system is capable of reliably converting relatively high pressure product from a product source in the field to a relatively low pressure product at ground temperature for use in the commissioning process, the above described advantages of the process cannot be achieved. The system, which includes methods for obtaining the necessary pressure drops, must be safe to operate, capable of performing these functions at remote job site locations and possess capabilities that will insure that enough source product can be processed at a rate sufficient to economically complete the commissioning process.

Referring to the drawing, a preferred embodiment of such a system is schematically depicted in FIG. 1. A valve on the pipeline carrying a petrochemical product is closed so as to separate the section of the line which is to be commissioned 2 from the section of the line which still contains product under normal service conditions 4. The product source 4 is tapped to provide a stream of products to be used in commissioning via conduit 6. Valve 10 is positioned so as to effect a pressure drop of the product prior to its entry into tube-shell heat exchanger 12. For most applications, a conduit 6 and pressure drop valve 10 should be sized so as to provide for flows of approximately 30,000 lbs/hr. and pressure drops of from 2200 psig to about 500 psig. The pressure drop will normally substantially reduce the temperature of the product and the cold product is delivered to the tubes of a conventional tube-shell heat exchanger. This pressure drop should be controlled so as to avoid excess refrigeration of the equipment. As the product is warmed in the tube-shell heat exchanger, it attains a temperature higher than the ground temperature of the line which is to be commissioned. As an example, temperatures in the range of about 140° F. are appropriate when ethylene is the product. The warmed product exits the tube-shell heat exchanger via conduit 14 and experiences a second pressure drop as it passes through valve 16 via return conduit 20. Valve 16 actually controls the pressure upstream in the heat exchanger controlling the pressure therein so that excessive refrigeration does not occur. The second pressure drop will cause the temperature of the warmed product to drop and by controlling the temperature of the tube-shell heat exchanger and the settings of valve 16 the temperature of the product entering the section of the line which is to be commissioned can be fairly closely matched to the ground temperature of the low pressure nitrogen contained therein. A fired heater 22 fueled, for example, by diesel fuel, can use an open flame burning system to heat a heat transfer fluid which is pumped through the shell side of the tube-shell heat exchanger. A suitable heat transfer fluid is a mixture of glycol and water. Typically, heaters rated at from about 3 million to about 6 million btu's will be suitable for use in this process. By physically separating the fired heater from the tube-shell heat exchanger, the possibility of exposure of flammable products (such as ethylene or propylene, etc.) to uncontrolled high temperatures or to open flame is eliminated.

The operation of the system and process of this invention ca be further illustrated by the following example.

EXAMPLE

An example of the processing system of the present invention would be the commissioning of an ethylene pipeline which contains nitrogen. A trailer mounted heater system including a tube-shell heat exchanger and fired heater is moved to the job site located near the pipeline. The inlet of the tubes in the exchanger are connected to a nearby ethylene source and the discharge end of the exchanger's tubes are connected to the pipeline to be commissioned. Air present in the heat exchanger and connecting piping is purged with nitrogen. The nitrogen is then, in turn, purged out with ethylene. A fired heater is started and checked for proper operation. A water/glycol mix is circulated through the fired heater and then through the shell side of the exchanger. As soon as the water/glycol temperature reaches approximately 150° F., ethylene from a 1100 psig source is throttled through a valve and into the exchanger at approximately 500 psig. The temperature of the ethylene is brought up to approximately 140° F. This warm ethylene is then passed through another throttling valve where the pressure is allowed to drop to approximately 50 psig, the pressure of the nitrogen in the pipeline.

When the pressure of the ethylene is dropped to pipeline pressure, the temperature drops to approximately 80° F., ground temperature or the temperature of the nitrogen in the pipeline. At this temperature and pressure, nitrogen and ethylene have basically the same density. Under these conditions, the nitrogen can be pushed out of the pipeline with the ethylene with virtually no contamination to the ethylene from the nitrogen. The temperature and pressure of ethylene entering the pipeline is maintained near this level until the ethylene arrives at the discharge end of the pipeline. At this point in the process, a sample of the ethylene is taken and analyzed to check for nitrogen contamination. Once ethylene purity meets the specification, the ethylene heating is continued as the pipeline is filled to approximately one-half of the source pressure. At this point extreme refrigeration due to a pressure drop between the source and the line being commissioned is no longer a serious danger. The heater can then be shut down and the pipeline owner can open the permanent valve and finish filling the pipeline with ethylene at a safe rate up to operating pressure.

While this invention has been described in relation to its preferred embodiments, it is to be understood that various modifications thereof will be apparent to those of ordinary skill in the art upon reading the specification and it is intended to cover all such modifications as fall within the scope of the appended claims.

I claim:

1. A process for commissioning a pipeline containing an inerting gas comprising adding heat to the product to be introduced into the pipeline such that the temperature of the product just after delivery into the line will approximate the temperature of the inerting gas in the pipeline.

2. The process of claim 1, wherein heat is added by employing a first controlled pressure drop, between the product source and a heat source, said pressure drop being controlled so as to avoid excessive refrigeration of the piping and equipment, adding heat to the product to raise it above the temperature of the nitrogen in the pipeline, and allowing a second drop in pressure to bring the temperature of the product down to approximately the temperature of the nitrogen in the pipeline.

3. The process of claim 2, wherein said heat source comprises a tube-shell heat exchanger wherein the product passes through the tubes and a heat transfer fluid is circulated through the shell.

4. The process of claim 3, wherein said heat transfer fluid is a glycol/water solution heated by a fuel burning heater separated from said tube-shell heat exchanger.

5. The process of claim 1, wherein said inerting gas is nitrogen.

6. The process of claim 1, wherein said product is ethylene.

7. A system for commissioning petrochemical pipelines which have been inerted with nitrogen comprising:

(a) means for withdrawing intended petrochemical product from a source thereof;

(b) first pressure drop means for reducing the pressure of the product as compared to its source;

(c) heater means for controlled heating of product to a temperature above the temperature of the nitrogen in the line being commissioned; and (d) second pressure drop means for reducing the pressure of the product such that its temperature after entering the pipeline approximates the temperature of the nitrogen contained therein.

8. A portable system for use in commissioning a pipeline filled with nitrogen, comprising:

a) a fired burner for heating a heat transfer fluid;

b) a tube-shell heat exchanger connected to said burner such that said heat transfer fluid circulates through one side thereof;

c) means for maintaining desired product pressure within the tube-shell heat exchanger as product passes therethrough; and c) means for reducing the pressure of the heated product such that its temperature after entering the pipeline approximates the temperature of the nitrogen contained therein.

* * * * *

UNITED STATES PATENT AND TRADEMARK OFFICE

CERTIFICATE OF CORRECTION

PATENT NO. : 5,027,842

DATED : July 2, 1991

INVENTOR(S) : Marvin D. Powers

It is certified that error appears in the above-identified patent and that said Letters Patent is hereby corrected as shown below:

Column 5, line 24, delete "hot" and add --hottest the product--.

Column 6, line 43, "ca" should be --can--.

Signed and Sealed this

Thirteenth Day of October, 1992

*Attest:*

DOUGLAS B. COMER

*Attesting Officer*

*Acting Commissioner of Patents and Trademarks*